US005460278A

United States Patent [19]

Schonebaum

[11] Patent Number: 5,460,278

[45] Date of Patent: Oct. 24, 1995

[54] CUPBOARD ORGANIZER KIT

[76] Inventor: Gregory M. Schonebaum, 3503 S. Richfield Cir., Aurora, Colo. 80013

[21] Appl. No.: 247,892

[22] Filed: May 23, 1994

Related U.S. Application Data

[63] Continuation-in-part of Ser. No. 24,466, Mar. 1, 1993, abandoned.

[51] Int. Cl.[6] ..... A47F 5/00

[52] U.S. Cl. ..... 211/88; 211/71

[58] Field of Search ..... 211/88, 10, 189, 211/71

[56] References Cited

U.S. PATENT DOCUMENTS

| | | | |
|---|---|---|---|
| D. 191,924 | 12/1961 | Meade et al. | 211/88 X |
| 1,292,914 | 1/1919 | Kelley . | |
| 3,116,773 | 1/1964 | Kikas . | |
| 3,139,133 | 6/1964 | Spector . | |
| 3,684,102 | 8/1972 | Colter | 211/88 |
| 4,022,261 | 5/1977 | Russell . | |
| 4,177,909 | 12/1979 | Haskell . | |
| 4,580,667 | 4/1986 | Harwood . | |
| 4,585,127 | 4/1986 | Benedict . | |
| 4,686,570 | 8/1987 | Medou . | |
| 4,736,853 | 4/1988 | O'Mara | 211/88 |
| 4,779,742 | 10/1988 | Starkweather | 211/88 X |
| 4,901,899 | 2/1990 | Barrett . | |
| 4,953,764 | 9/1990 | Little et al. . | |
| 5,000,327 | 3/1991 | Kincheloe | 211/88 |

*Primary Examiner*—Alvin C. Chin-Shue
*Assistant Examiner*—Sarah L. Purol

[57] ABSTRACT

A kit for organizing small items comprises an open topped envelope shaped unit which is attached to the cupboard or a rod which is attached to the cupboard and containers which fit into the unit. The unit and containers are made up of a backing and one or more panels which are attached, at the edges, to the backing and form a pocket(s).

17 Claims, 2 Drawing Sheets

CUPBOARD ORGANIZER KIT

BACKGROUND OF THE INVENTION

This is a continuation in part of my U.S. Pat. application Ser. No. 08/024,466 having the same title and filed Mar. 1, 1993, now abandoned.

A variety of organizers are available for attachment to walls, etc., and for carrying by individuals. These organizers differ in construction, depending on their usage. Door-hung devices are taught by the following patents:

U.S. Pat. No. 1,291,914 issued to L. M. Kelley teaches an organizer to be attached to the back of the front seat of an automobile or folded for use in the trunk. In its construction, a material is folded to make a wide, deep pocket and closed at the sides by stitching or snap links. Reinforcing is obtained by doubling the sides and upper edges over on themselves. A fold is taken in the center and snap links can be used to support a pocket. Rings are attached to the upper corners so that a rod can be run through them for attachment to the auto. Both shallow, wide and narrow pockets can be stepped down the face of the deep pocket.

U.S. Pat. No. 3,116,773 issued to Leonard Kikas teaches a kit using vertical straps which are attached to a closet door using grommets. Various sizes of pockets are then attached to the straps.

U.S. Pat. No. 3,139,133 to Lenore Spector teaches a rod-hung organizer using zippers to close its pockets.

U.S. Pat. No. 4,953,765 to V. A. Little et al teach an organizer for horse groomers with a backing which is to be hung on a wall and an apron to be worn around the waist of the groomer. Pouches are sewn on the backing to hold some items and removable pockets are attached to a portion of the backing with hook and loop fasteners. The removable pockets are attached to the groom's apron, as needed.

U.S. Pat. No. 4,585,127 to C. E. Benedict teaches a garment bag device to be hung on a telescoping rod within a closet where the pockets are sealed with hook and loop fasteners.

Portable organizers, e.g., knapsacks, purses, valises and briefcases differ from the organizers attached to doors, etc., in that they often have both separators which form pockets and removable pockets. Thus, a ladies' purse will often have fixed dividers and one or more removable purses for coins, cosmetics and other articles. Typical portable organizers are taught in:

U.S. Pat. No. 4,022,261 to D. B. Russell teaches a handbag with a double wall. The outer wall is segmented and transparent for displaying pictures. The purse can carry the usual coin, etc. purses.

U.S. Pat. No. 4,177,909 to L. O. Haskell teaches a combination of knapsack containing a purse which, in turn, contains cosmetic, etc. purses. All are separable.

U.S. Pat. No. 4,580,667 to B. K. Harwood teaches removable separators for wallets, purses, etc. with pockets.

U.S. Pat. No. 4,685,570 to Shiela Medow teaches a tote made up of a sheet folded in the middle with straps or stiffener handles on the long edges and a variety of pockets which are closed by Velcro-type fasteners.

U.S. Pat. No. 4,901,899 to G. P. Barrett teaches a portable replacement for tackle, tool, etc. boxes. The replacement has a master carrier to which modular carriers are attached with zippers, depending on the contents of the modular carriers. Each of the carriers have separate side-by-side pockets. Fish hooks and other small items can be stored within a container in a selected pocket.

The art does not indicate that the problems inherent in organizing cupboards and vanity cabinets has been addressed. Problems arise from the fact that cupboards and variety cabinets are often above shoulder level or below waist level and, as a result, are difficult to peer into from the standing position. These problems are solved with a kit. The use of the kit enables the user to store small items in containers which can be removed from container storage pockets in a door or rod mounted wall. When appropriate, the containers are removed and placed on a counter top or table for inspection, reorganization, etc.

SUMMARY OF THE INVENTION

The organizers are made up of a door or rod mountable unit and containers of desired sizes. The unit has, when viewed from back to front, several pockets made up of a backing and panels, each panel is more shallow than the adjacent one behind it. The containers are smaller, are made up of a backing and one or more panels and sized to hold predetermined items or collections of items.

DETAILED DESCRIPTION OF THE DRAWINGS

Figure 1:
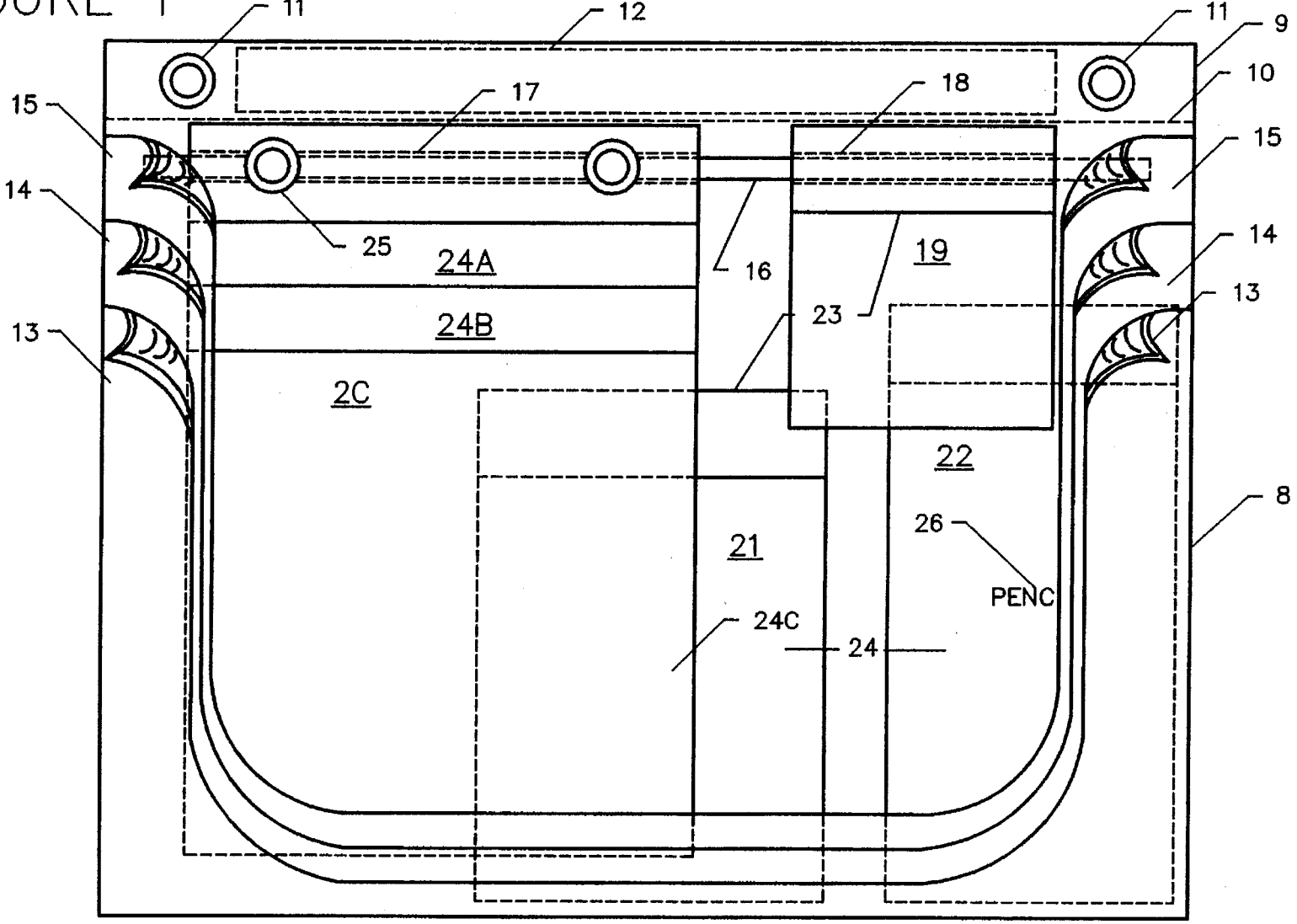
FIG. 1 is a front cutaway elevation view of a door mountable unit with several containers positioned in the deepest, i.e., most rearward, pocket.

FIG. 1 shows a kit made up of a unit and four containers. The unit has a backing 9 which has been folded 10 to reinforce the area where grommets 11 are placed. A segment 12 of hook and loop fastener is attached to the rear surface of backing 9. Panels 13, 14 and 15 are partially cut away. A segment 16 of hook and loop fastener is attached to the face of backing 9. Second segments 17 and 18 of hook and loop fastener are attached to the rear of containers 19 and 20. Other containers 21 and 22 set on the bottom of unit 8. Each of containers 19, 21 and 22 have a single pocket formed by backings 23 and panels 24. Container 20 has three pockets formed by backing 23*a* and panels 24*a*, 24*b* and 24*c*. Container 20 also includes grommets 25 for attachment to the pegs, rods, etc. holding unit 8. Letters 26 identify the intended contents of unit 22 and are representative of designs and designations which can be used with the kits.

Figure 2:
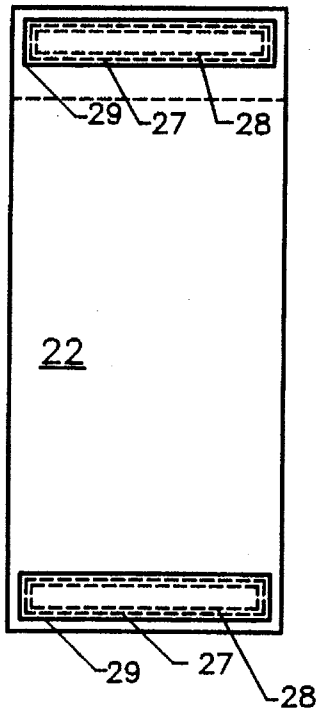
FIG. 2 is a rear view of a container and attachment devices.

FIG. 2 shows the rear of container 22 with hook and loop segments 27 and 28 attached to container 22 and a contact adhesive layer not shown covered by a nonadhesive, pull-off covering 29.

Figure 3:
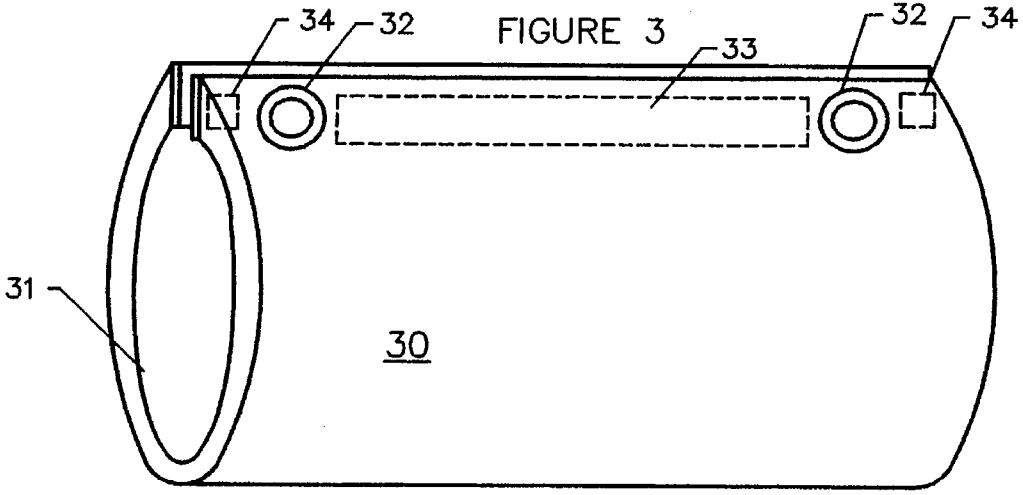
FIG. 3 is a tote with an attachment mechanism.

FIG. 3 is a perspective view of a tote 30 used for necklaces, etc. with open ends 31, grommets 32 and, on the reverse side, hook and loop fastener segment 33. Another fastener segment 34 is used to close the top of the tote.

Figure 4:
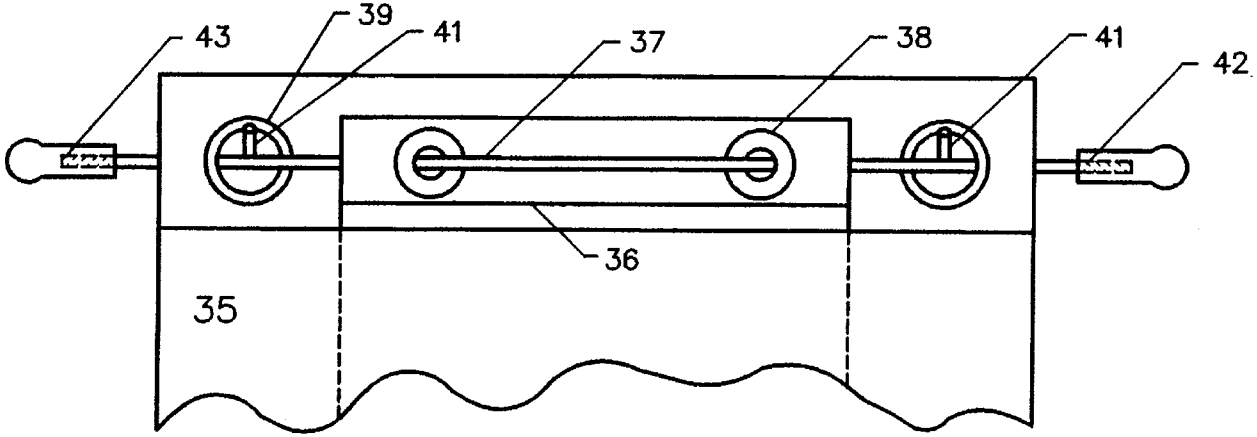
FIG. 4 shows a unit with a container positioned with a rod.

FIG. 4 depicts a unit 35 having large nested container 36. Both are suspended on an attachment rod 37 which has been passed through the holes in grommets 38 and 39 respectively. Unit 35 is hung on pegs 41. Rod 37 has threaded ends 42 on which nuts 43 have been screwed.

GENERAL DESCRIPTION OF THE INVENTION

The organizers are designed to be used in cupboards and cabinets where space is limited. As a result, they are not designed to hold large, heavy articles. They are intended to contain bills, coupons, reminder notes, pencils, etc. which normally get scattered in drawers, etc.

The organizers can also be designed for use where children and pets may attempt to remove the organizer from its support(s), remove the containers from the organizer and the contents from the container. They can also be designed to permit the draining and/or drying of wet objects placed in either the unit or container. Such organizer designs may be made of any suitable material; for example, at least a portion of the kit materials can have fine pores, larger perforations, or even construction from a netting material.

The unit is often shaped much like a large envelope for office use. The unit is designed so that A-4, 8.5"×11" and 8.5"×14" papers can be stored comfortably therein. The containers will be smaller and can be a variety of shapes and sizes. Preferably, the unit will have at least two and preferably three or four panels which form increasingly more shallow pockets from back to front. At least a portion of the front panel is preferably transparent so that an inventory of the items can be visibly stored in the unit.

The backing for the units can be rigid but is preferably of a flexible material. A stiffener of metal, plastic or paperboard can be inserted in the rearmost pocket as a stiffener or within the materials from which the backing of the unit is made.

The storage units and containers can be made of a dimensionally stable plastic, e.g., polyester, or a minimally stretchable flexible plastic such as polyvinyl chloride. Alternately, the units and containers can be made of one or more fabrics. Both can have designs and/or indicia of ownership, contents, etc. printed, sewn or adhered thereon.

Where organizers are to be stored, e.g., in hanging files or where short term usage is contemplated, e.g., where shop usage renders them filthy. The organizers can be made of paper or paper products. The paper can be made stiffer, stronger, water, soil or oil resistant by plastic, wax or polymer impregnation or plastic and/or metallic film coating(s).

The upper edge of the backing of the support units and containers will normally be reinforced, usually by doubling over the material from which these items are constructed and sewing, gluing or fusing the doubled materials together. This reinforcement is especially needed where grommets are used for hanging the units on nails, rods or pegs. Where the edges of materials are sewn to form the units and containers, the usual folding over of the edges should be double-stitched to reinforce the seams. Where plastic is utilized, the plastic can be glued, thermally fused or sewn; particularly where a cloth backing is used, e.g., with Naugahyde-type materials.

Where a hook and loop fastener is used to attach the unit to a cabinet door or wall, the fastener is preferably attached to the unit and sometimes to one or more of the containers along the reinforced upper rear edge of the unit and/or container. Hook and loop fasteners can also be attached to the inner surfaces of the unit and one or more containers to position, respectively, units and smaller containers. Where hook and loop fasteners are used, care must be taken to ensure that the surface of the object to which the hook or loop segments are to be attached is suitable for attachment of the segment. Other fasteners can be used; however, e.g., zippers.

These fasteners are particularly useful for maintaining a small container at the top of the unit so that it can be easily removed without removing taller containers and for positioning the containers at desired locations within the unit and keeping tall narrow containers vertical. Basically, these types of fasteners are used to ensure that the unit and containers are easily mountable on other objects, e.g., walls, pegs, rods, etc. and are readily separable therefrom.

I claim:

1. A mountable organizer comprising:

a unit having a backing means and at least one panel means, both connected to form a storage unit having at least one open topped pocket, and at least one open topped container means having at least one backing and at least one panel means connected to form the at least one container, having a smaller size and/or shape for positioning in the unit, the at least one unit and the at least one container having at least one attachment means for separable connection to another object and the unit and at least one container having a plurality of first panels, the panels forming pockets of decreasing depth from back to front.

2. The organizer of claim 1 wherein the attachment means are positioned in the backing above the at least one panel(s).

3. The organizer of claim 1 wherein the attachment means are grommets.

4. The organizer of claim 1 wherein the attachment means are hook and loop fasteners.

5. The organizer of claim 1 wherein the backing and panels are made of a plastic.

6. The organizer of claim 1 wherein the backing and panels are made of a fabric.

7. The organizer of claim 1 wherein the backing and panels are one of paper and paper products.

8. The organizer of claim 4 wherein one of a hook and loop fastener is attached to at least the rear surface of at least one of the unit and at least one container.

9. The organizer of claim 7 wherein the hook and loop fasteners are on both the rear and front surfaces of the backing means.

10. The organizer of claim 8 wherein the hook and loop fasteners are additionally on at least one of the front and rear surfaces of at least one panel of a container.

11. The organizer of claim 1 wherein there is a plurality of containers.

12. The organizer of claim 11 wherein the plurality of containers are of different sizes.

13. The organizer of claim 1 wherein the backing is substantially rigid.

14. The organizer of claim 1 wherein the backing is substantially flexible.

15. The organizer of claim 11 wherein the at least one panel is of a transparent film.

16. The organizer of claim 11 wherein the most shallow panel is of a transparent film.

17. The organizer of claim 1 wherein the at least one of the unit and container is pervious to air and water.

* * * * *